US005521045A

United States Patent [19]

Funato et al.

[11] Patent Number: 5,521,045

[45] Date of Patent: May 28, 1996

[54] TONER FOR A TWO-COMPONENT-TYPE MAGNETIC DEVELOPING AGENT HAVING EXCELLENT SPENT RESISTANCE

[75] Inventors: Masatomi Funato; Yoshitake Shimizu; Seijiro Ishimaru; Kazuya Nagao, all of Osaka, Japan

[73] Assignee: Mita Industrial Co., Ltd., Osaka, Japan

[21] Appl. No.: 343,975

[22] Filed: Nov. 18, 1994

[30] Foreign Application Priority Data

Nov. 19, 1993 [JP] Japan ..... 5-291021

[51] Int. Cl.[6] ..... G03G 9/083

[52] U.S. Cl. ..... 430/106.6; 430/904

[58] Field of Search ..... 430/106, 106.6, 430/110, 904

[56] References Cited

U.S. PATENT DOCUMENTS 5,213,933 5/1993 Osaki et al. ..... 430/106.6
5,246,809 9/1993 Funato et al. ..... 430/106.6
5,364,720 11/1994 Nakazawa et al. ..... 430/106.6

FOREIGN PATENT DOCUMENTS 0005334 11/1987 European Pat. Off. .
0380813 8/1990 European Pat. Off. .
0453907 10/1991 European Pat. Off. .
3515191 11/1985 Germany .
2107893 5/1983 United Kingdom .

*Primary Examiner*—John Goodrow
*Attorney, Agent, or Firm*—Sherman and Shalloway

[57] ABSTRACT

A toner in which a small amount of magnetic powder is disposed in a resin medium for fixing which comprises a cationic polar group-containing copolymer resin or a resin composition. A distinguished feature resides in that the toner does not contain a charge control agent. The toner is positively charged and exhibits very good spent resistance. The toner further exhibits favorable electrophotographic properties such as transfer efficiency despite there is contained no charge control agent.

7 Claims, 6 Drawing Sheets

TONER FOR A TWO-COMPONENT-TYPE MAGNETIC DEVELOPING AGENT HAVING EXCELLENT SPENT RESISTANCE

BACKGROUND OF THE INVENTION

1. Field of the Invention

The present invention relates to a positively-charging toner for a two-component-type magnetic developing agent having excellent spent resistance. More specifically, the invention relates to a toner which contains no charge control agent, does not scatter during the developing, enables the image to be efficiently transferred, makes it possible to form an image of a high density, and helps extend the life of the toner and the carrier.

2. Description of Prior Art

A so-called two-component-type magnetic developing agent has been extensively used for developing electrostatic charge image formed on an electrophotosensitive material.

The two-component-type magnetic developing agent comprises a composition of a magnetic carrier of an iron powder or ferrite grains and an electroscopic toner composed of a coloring resin composition. To carry out the developing, the magnetic carrier and the toner are mixed together to electrically charge the toner grains to a predetermined polarity, the mixture is carried to the photosensitive material in the form of a magnetic brush, the surface of the photosensitive material is rubbed by the magnetic brush, and the electrically charged toner is adsorbed and held by the charge image on the surface of the photosensitive material to form a visible image.

A charge control agent is usually contained in the toner grains in order to control the polarity of the toner grains by frictional charging. A negative charge control agent such as a metal-containing complex salt dyestuff or a metal complex of oxycarboxylic acid is used for the negatively-charging toner (e.g., see Japanese Laid-Open Patent Publication No. 67268/1991), and a positive charge control agent such as an oil-soluble dyestuff like Nigrosine or an amine control agent is used for the positively-charging toner (e.g., see Japanese Laid-Open Patent Publication No. 106249/1981).

It has long been known to use a magnetic toner as a toner for the two-component-type magnetic developing agent. For instance, the above Japanese Laid-Open Patent Publication No. 106249/1981 and Japanese Laid-Open Patent Publication No. 162563/1984 disclose a magnetic powder-containing toner which contains a magnetic powder therein. The above Japanese Laid-Open Patent Publication No. 67268/1991 discloses a magnetic powder-carrying toner obtained by adding and mixing a silica powder and a magnetic powder to the toner.

It has been known that the two-component-type magnetic developing agent exhibits satisfactory electrical charging performance in an initial state of when the magnetic carrier and the toner are used being mixed together but loses its charging performance due to the formation of a so-called spent (toner) and its life is shortened.

The spent (toner) is a phenomenon in which the toner component adheres and precipitates like a film on the surface of the magnetic carrier. Since the surface of the magnetic carrier becomes close to that of the toner, the triboelectricity approach each other making it difficult: to obtain a desired charging performance. When the spent is formed, therefore, the magnetic carrier must be replaced by a new one.

SUMMARY OF THE INVENTION

It is therefore an object of the present invention to provide a positively-charging two-component-type magnetic developing agent which has excellent spent resistance and enables the toner and the carrier to extend their life.

Another object of the present invention is to provide a toner for a (CCA-less) positively-charging two-component-type magnetic developing agent, which exhibits a property of migrating toward a magnetic carrier, and is capable of increasing the apparent developing sensitivity without permitting the toner to scatter during the developing despite the fact that there is no CCA (charge control agent).

A further object of the present invention is to provide a CCA-less positively-charging two-component-type magnetic developing agent which enables the image to be efficiently transferred from the surface of the photosensitive material onto a paper despite the fact that there is no migratory charge control agent.

According to the present invention, there is provided a positively-charging toner for a two-component-type magnetic developing agent having excellent spent resistance, wherein the resin medium for fixing is a copolymer resin or a resin composition having cationic polar groups and contains a magnetic powder in an amount of from 0.1 to 5 parts by weight per 100 parts by weight of said resin medium, and wherein an extract of said toner, produced by extracting said toner with methanol, exhibits absorbancies which are substantially zero at absorption peaks over wavelengths of from 400 to 700 nm.

According to the present invention, furthermore, there is provided a toner for a two-component-type developing agent having excellent spent resistance and transfer efficiency by adhering a fine powdery fluidity-improving agent onto the surfaces of the toner grains having grain sizes of from 5 to 15 μm on the basis of volume, said fine powdery fluidity-improving agent containing spacer grains having grain sizes of from 0.05 to 1.0 μm on the basis of volume.

DETAILED DESCRIPTION OF THE INVENTION

Figure 1:
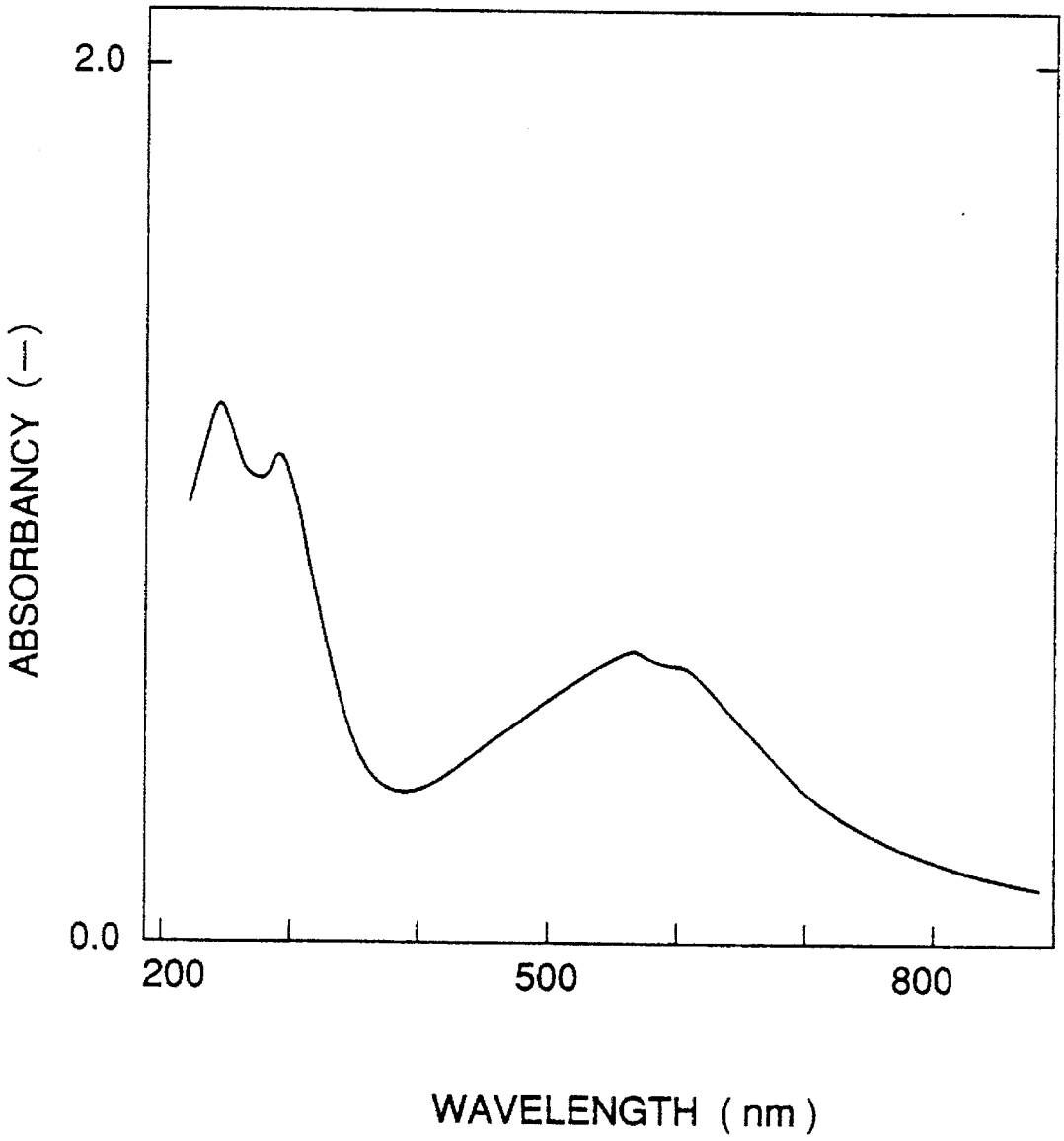
FIG. 1 is a graph showing a curve of absorbancies at wavelengths 400 to 700 nm of a methanol extract of a toner containing an oil-soluble dyestuff as a charge control agent.

In the accompanying drawings, FIG. 1 is a graph showing a curve of absorbancies at wavelengths 400 to 700 nm of a methanol extract of a toner containing an oil-soluble dyestuff as a charge control agent among the conventional toners for the two-component-type magnetic developing agents used for developing negatively charged image.

From these results, the above extract exhibits characteristic absorption peaks based upon a charge control agent, meaning that tile charge control agent is adhered to the surfaces of the toner grains at a considerably high concentration. This fact matches well with an idea that the charge control agent contained inside the toner migrates onto the surfaces of the toner grains, and the electric charge due to the frictional charging is controlled by the migration of the charge control agent.

Figure 2:
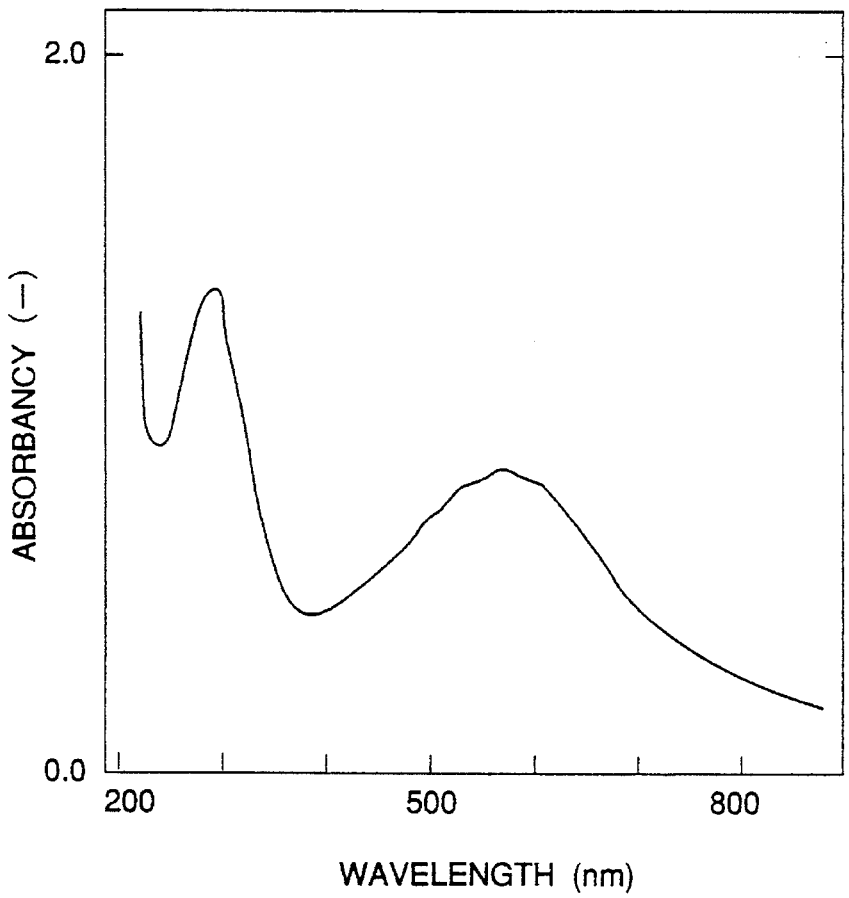
FIG. 2 is a graph showing a curve of absorbancies at wavelengths 400 to 700 nm of a methanol abstract, when the toner used in the measurement of FIG. 1 is used as a two-component-type magnetic developing agent, and those carriers that have developed poor charging due to the spent are extracted with methanol.

FIG. 2 is a graph showing a curve of absorbancies at wavelengths 400 to 700 nm of a methanol extract when the toner used in the measurement of FIG. 1 is used as a two-component-type magnetic developing agent, and those carriers that have developed poor charging due to the spent are extracted with methanol.

According to the above results of measurement, the charge control agent is adhered and precipitated at a high concentration even on the surfaces of the carrier, revealing an astonishing fact that poor charging due to the spent is not a simple filming on the carrier surfaces due to the toner resin that was so far considered but is the migration of the charge control agent onto the surfaces of the carrier.

Figure 3:
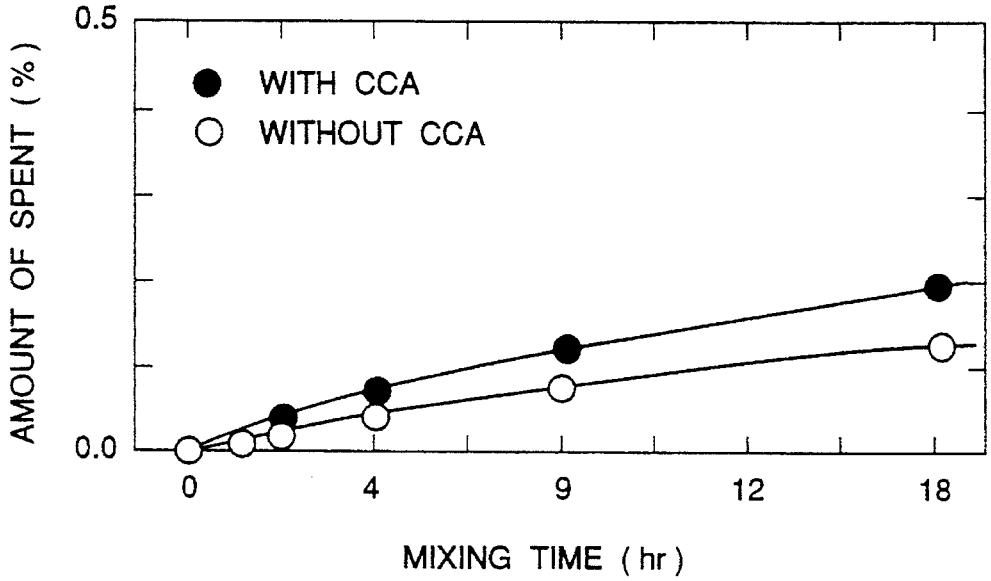
FIG. 3 is a graph plotting relationships between the mixing time and the amount of spent of when a mixture of a toner containing a charge control agent and a magnetic carrier as well as a mixture of a toner without containing charge control agent and the magnetic carrier, are mixed.
Figure 4:
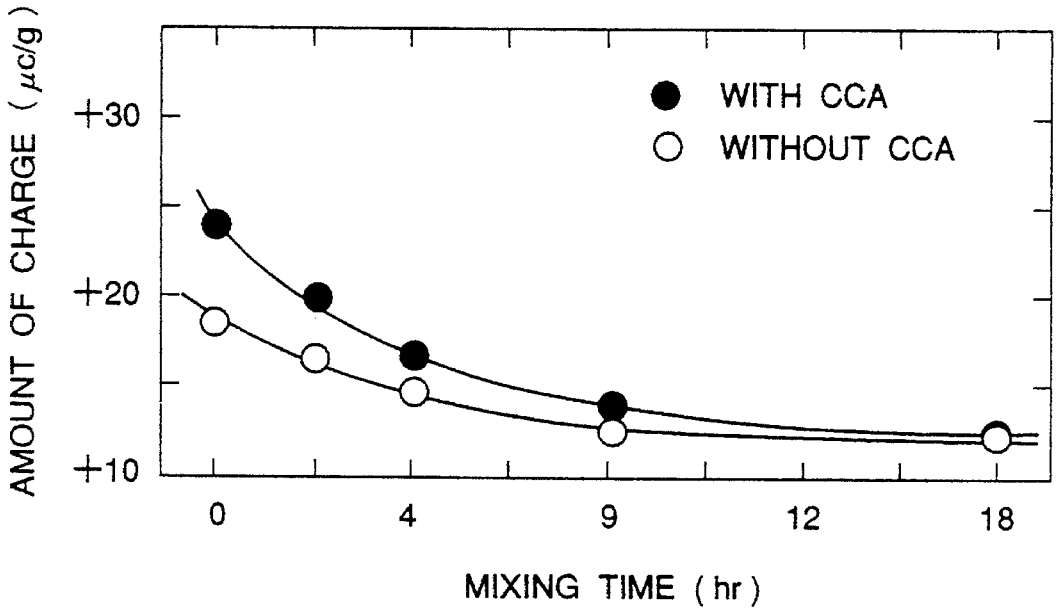
FIG. 4 is a graph plotting relationships between the mixing time and the amount of charge of when a mixture of a toner containing a charge control agent and a magnetic carrier as well as a mixture of a toner without containing charge control agent and the magnetic carrier, are mixed.

This fact will become more apparent from FIGS. 3 and 4 which are graphs plotting relationships between the mixing time and the amount of spent and relationships between the mixing time and the amount of charge, respectively, when a mixture of a toner containing a charge control agent and a magnetic carrier as well as a mixture of a toner not containing a charge control agent and the magnetic carrier, are mixed. From these results, a fact becomes obvious that the toner containing the charge control agent gives an increased amount of spent and a decreased amount of charge compared with the toner which does not contain the charge control agent.

Figure 5:
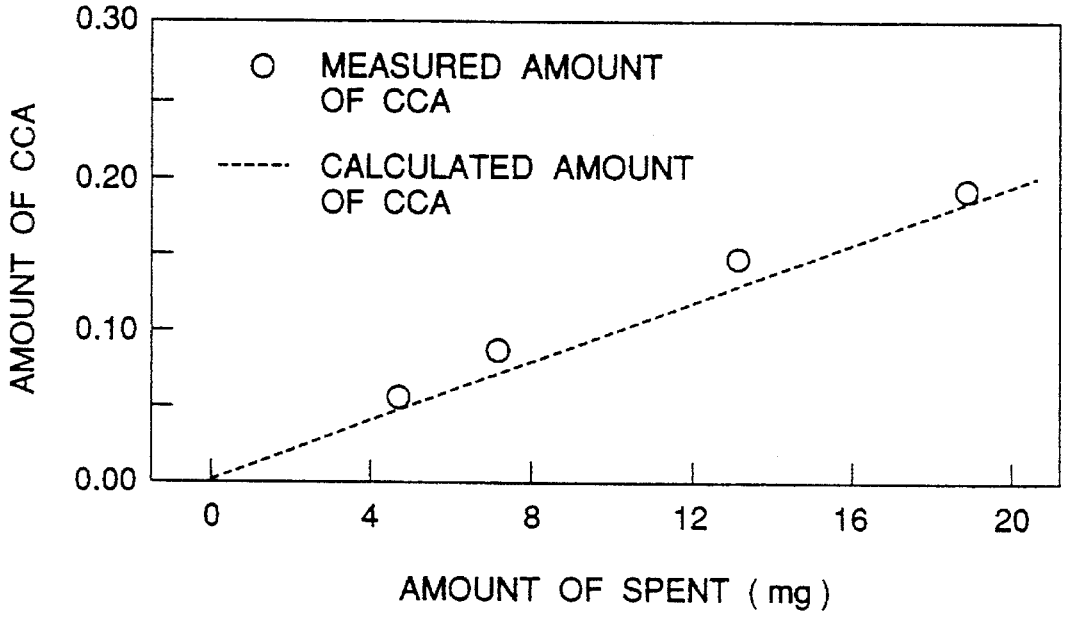
FIG. 5 is a graph showing a relationship between the amount of spent of the carrier to which the spent has adhered and the charge control agent in the spent toner.

FIG. 5 is a graph measuring a relationship between the amount of spent and the charge control agent in the spent toner, and wherein a dotted line is drawn by plotting values calculated from the toner recipe. It becomes obvious from the above results that the charge control agent is selectively migrating and is adhering onto the surfaces of the carrier in the initial stage. The results of FIGS. 4 and 5 are those of a closed system where no toner is replenished. When the toner is renewed in a copying machine, it is expected that the difference will further increase depending upon the presence or absence of the charge control agent.

Figure 6:
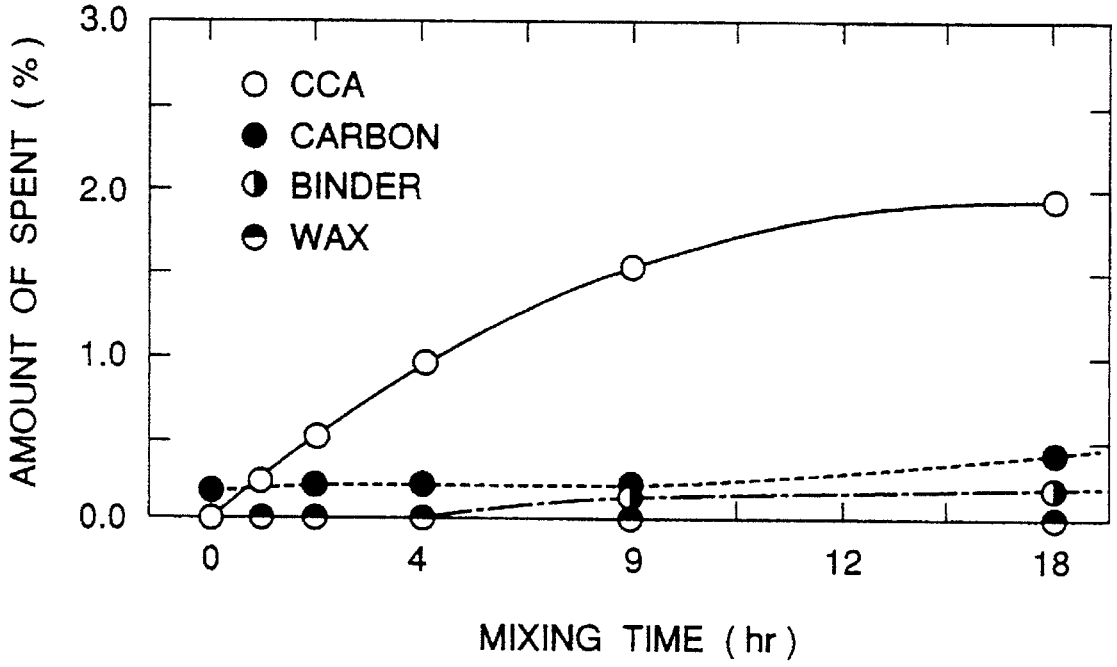
FIG. 6 is a graph illustrating relationships between the mixing time and the amount of spent when each of the components in the toner and the magnetic carrier are mixed.

FIG. 6 is a graph illustrating relationships between the mixing time and the amount spent of when each of the components in the toner and the magnetic carrier are mixed. These results clarify a fact that among many components in the toner, the charge control agent overwhelmingly migrates toward the surface of the carrier giving rise to the formation of spent.

Figure 7:
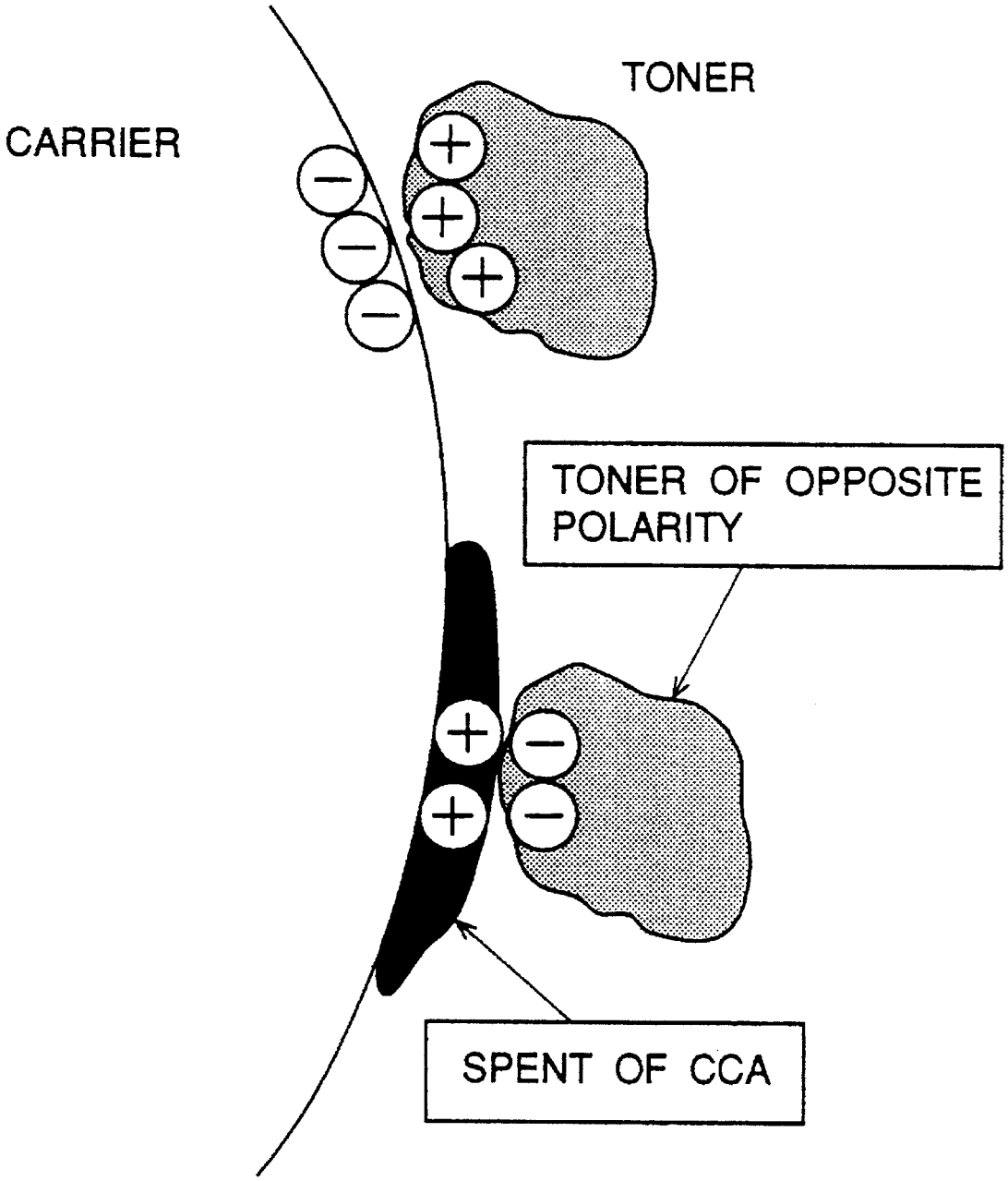
FIG. 7 is a diagram illustrating the occurrence of poor charging due to the formation of the spent using a conventional two-component-type magnetic developing agent.

From the foregoing as illustrated in the diagram of FIG. 7, it can be explained that the poor charging of the conventional two-component-type magnetic developing agent due to the formation of spent stems from the fact that in the initial stage in which the mixture is used, the carrier is negatively charged and the toner is positively charged but as the charge control agent selectively migrates onto the surfaces of the carrier to form the spent, then the spent layer is positively charged, causing the toner to be negatively charged.

Figure 8:
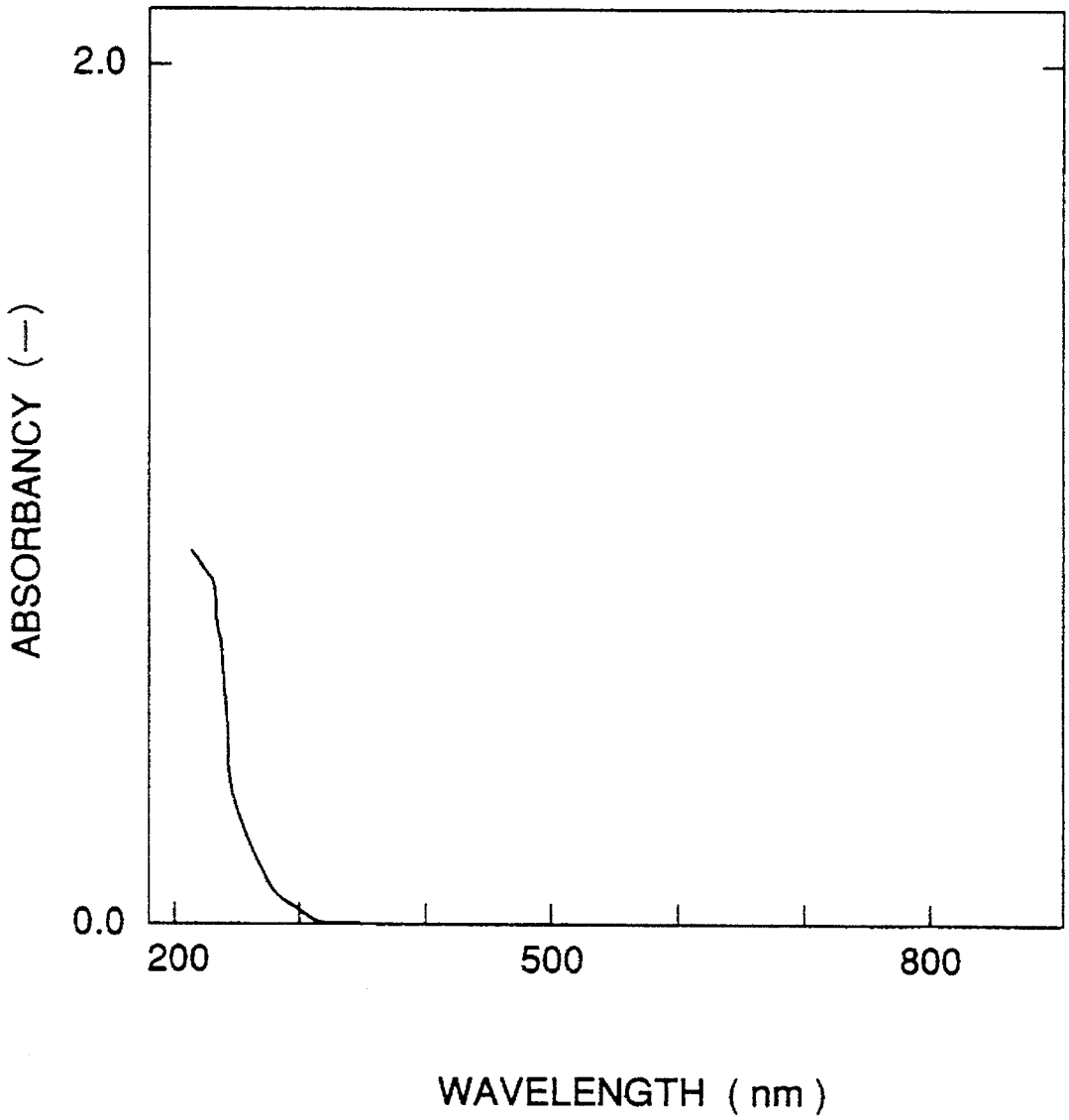
FIG. 8 is a graph showing a curve of absorbancies at wavelengths 400 to 700 nm (and at wavelengths 280 to 350 nm) of a methanol extract of the toner of the present invention.

In order to prevent the charge control agent from migrating onto the surfaces of the magnetic carrier, the toner grains according to the present invention do not contain or are not blended with the migratory charge control agent. When the toner of the present invention is extracted with methanol as represented by a curve of absorbancies of FIG. 8, therefore, the methanol extract exhibits no absorption peak over a wavelength region of from 400 to 700 nm or exhibits absorbancy which is substantially zero if it exists. Therefore, the charge control agent is suppressed from migrating onto the surfaces of the carrier and the spent resistance is improved, creating a first feature of the present invention.

Here, as shown in FIG. 4, the toner without containing the charge control agent has the amount of charge which is smaller than that of the toner blended with the charge control agent. To overcome this defect, the present invention uses, as a resin medium for fixing, a copolymer resin or a resin composition having cationic polar groups. Use of such a resin or resin composition makes it possible to obtain a property for controlling the electric charge of frictional charging that is at least required for the developing.

The cationic polar group gives charge control property to the toner. The cationic polar group that is bonded to the skeleton of resin does not migrate onto the surfaces of the toner grains but provides weak coulomb force for bonding the toner grains in the magnetic brush to the carrier during the developing. Therefore, the toner scatters conspicuously as the copying speed increases, and the copying machine is contaminated with the toner and the fogging density increases in the obtained copies.

In order to prevent this defect according to the present invention, the toner contains a magnetic powder in a particular amount to obtain magnetic attractive force between the toner and the carrier in addition to the coulomb force between the toner and the carrier, so that the toner is prevented from scattering.

According to the present invention, the apparent sensitivity is increased during the developing while preventing the toner from scattering, creating one of the distinguished merits of the invention. That is, the smaller the amount of electric charge per one toner grain, the larger the number of toner grains adhering to the electrostatic latent image of a predetermined amount of electric charge, and the apparent developing sensitivity increases.

According to the present invention, a distinguished advantage resides in the formation of image of a high density while preventing the toner from scattering by internally adding a magnetic powder in an amount of as small as from 0.1 to 5 parts by weight and, particularly, 0.5 to 3.0 parts by weight per 100 parts by weight of the resin medium. With the magnetic toner used for the conventional two-component-type magnetic developing agent, the magnetic powder must be used in an amount larger than 10 parts by weight per 100 parts by weight of the resin medium. According to the present invention, however, the magnetic powder is used in an amount far smaller than the above amount. When the magnetic powder is used in an amount which is smaller than 0.1 part by weight, the toner easily scatters and when it is used in an amount larger than 5 parts by weight, on the other hand, tile developing density decreases.

The toner to which the present invention is concerned has a thermal fixing property and must be imparted with a parting property during thermal fixing. As a parting agent, tile present invention selects a polypropylene having a number average molecular weight of not smaller than 7000 and blends it in an amount of from 0.1 to 6 parts by weight per 100 parts by weight of the resin medium. This makes it possible to further increase tile spent resistance of the toner while enabling the resistance against offset to be improved during the thermal fixing.

According to U.S. Pat. No. 4,988,598, a polypropylene having a number average molecular weight of from 2000 to 6000 that is used as a parting agent for the conventional thermal fixing toner exhibits a tendency of turning into a spent that adheres onto the carrier as described in Comparative Examples 1 to 4 appearing later. According to the present invention, however, use is made of a polypropylene having a number average molecular weight of not smaller than 7000 to markedly suppress the tendency of turning into the spent.

The reason is because the polypropylene having a number average molecular weight of smaller than 7000 is melted during the step of kneading for preparing the toner and exhibits a decreased viscosity to which a shearing force is little applied. Therefore, the polypropylene is poorly dispersed in the resin medium and forms the spent in large amounts relative to the carrier. The polypropylene having a number average molecular weight of not smaller than 7000 used in the present invention, on the other hand, exhibits an increased softening point, is little melted during the step of kneading, and to which a shearing force is well exerted, and is hence dispersed well in the resin medium, suppressing the formation of the spent.

When the blending amount of the polypropylene is smaller than the above-mentioned range, the resistance against the offset becomes insufficient and when the blending amount is larger than the above-mentioned range, the tendency of turning into the spent increases which is not desirable.

According to the present invention, the toner usually has a grain size of from 5 to 15 μm. Here, it is desired to adhere by external addition a fine powdery fluidity-improving agent containing spacer grains of sizes of from 0.05 to 1.0 μm onto the surfaces of the toner grains.

In general, in order to improve the powdery fluidity, a fluidity-improving agent such as fine granular silica or the like is adhered to the toner by external addition. According To the present invention, however, spacer gains of sizes of from 0.05 to 1.0 μm are contained in the fluidity-improving agent to weaken the bond between the toner image and the latent image on the surface of the photosensitive material, so that the toner image is easily peeled off, making it possible to improve the transfer efficiency in the step of transferring the toner image.

Resin Medium

The resin medium for fixing used in the present invention is a copolymer resin or a resin composition having cationic polar groups. The cationic polar group may be a primary, secondary or tertiary amino group, a quaternary ammonium group, or a basic nitrogen-containing group such as amide group, imino group, imide group, hydrazino group, guanidino group, amidino group or the like group. Among them, it is desired to use the amino group or the quaternary ammonium group.

As the above-mentioned resin, there can be used a resin obtained by the polymerization such as random copolymerization, block copolymerization or graft copolymerization of a cationic polar group-containing monomer with another monomer or resin. Described below are examples of the monomer.

Basic nitrogen-containing (meth)acrylic monomer:

Compounds represented by the general formula (1)

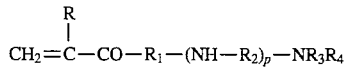

$$CH_2{=}C(R)-CO-R_1-(NH-R_2)_p-NR_3R_4 \quad (1)$$

wherein R is a hydrogen atom or a methyl group, $R_1$ and $R_2$ are each an alkylene group, $R_3$ and $R_4$ are each a hydrogen atom or an alkyl group, and p is zero or 1, or quaternary ammonium salt thereof.

Examples are dimethylaminoethyl methacrylate, dimethylaminoethyl acrylate, diethylaminoethyl methacrylate, diethylaminoethyl acrylate, dimethylaminopropyl methacrylate, dimethylaminopropyl acrylate, dibutylaminoethyl methacrylate, dimethylaminopropyl methacrylamide, N,N-dimethylaminoethyl-N'-aminoethyl methacrylate, 3-acrylamide-3,3-dimethylpropyl dimethylamine, and quaternary ammonium salts thereof.

Cationic polar group-containing vinyl monomer:

Examples are diallyldimethylammonium chloride, vinyltrimethylammonium chloride, N-vinylcarbazole, 2-vinylimidazole, N-vinylpyrrole, N-vinylindole, N-vinylpyrrolidone, and quaternary vinylpyridinium.

According to the present invention, furthermore, the above-mentioned resin may be the one that is obtained by introducing a cationic polar group to the terminal of a polymer that is formed by using a cationic polar group-containing polymerization initiator. Described below are examples of the polymerization initiator.

Azoamidine or Azoamide compounds:

Azoamidine or azoamide compounds represented by the following general formula (2),

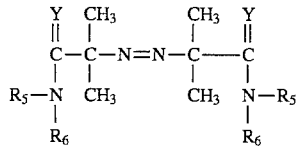

$$R_5-N(R_6)-C(Y)(CH_3)-C(CH_3)-N=N-C(CH_3)-C(Y)-N(R_6)-R_5 \quad (2)$$

wherein Y is an oxygen atom or a group $=N-R_7$, $R_7$ is a hydrogen atom or an alkyl group, $R_5$ is a hydrogen atom, a substituted or unsubstituted alkyl group, an alkenyl group or a substituted or unsubstituted aryl group, $R_6$ is a hydrogen atom or a substituted or unsubstituted alkyl group and, when the group Y is $=N-R_7$, the group $R_7$ and the group $R_5$ in combination may form a substituted or unsubstituted alkylene group.

Examples include:

2,2'-azobis(2-methyl-N-phenylpropionamidine) dihydrochlorate, 2,2'-azobis[N-(4-chlorophenyl)-2-methyl]propionamidine) dihydrochlorate, 2,2'-azobis[N-(4-hydroxyphenyl)-2-methyl]propionamidine) dihydrochlorate, 2,2'-azobis[N-(4-aminophenyl)-2-methyl]propionamidine) dihydrochlorate, 2,2'-azobis[2-methyl-N-(phenylmethyl)propionamidine) dihydrochlorate,
2,2'-azobis(2-methyl-N-propenylpropionamidine) dihydrochlorate,
2,2'-azobis(2-methylpropionamidine) dihydrochlorate,
2,2'-azobis[N-(2-hydroxyethyl)-2-methyl]propionamidine) dihydrochlorate,
2,2'-azobis[2-(5-methyl-2-imidazoline-2-il)propane]dihydrochlorate,
2,2'-azobis[2-(2-imidazoline-2-il)propane]dihydrochlorate,
2,2'-azobis[2-(4,5,6,7-tetrahydro-1H-1,3-diazepine- 2-il-)propane]dihydrochlorate,
2,2'-azobis[2-(3,4,5,6-tetrahydropyrimidine-2-il)propane] dihydrochlorate,
2,2'-azobis[2-(5-hydroxy-3,4,5,6-tetrahydropyrimidine-2-il)propane]dihydrochlorate,
2,2'-azobis{2-[1-(2-hydroxyethyl)-2-imidazoline-2-il] propane}dihydrochlorate,
2,2'-azobis[2-(2-imidazoline-2-il)propane],
2,2'-azobis{[2-methyl-N-[1,1-bis(hydroxymethyl)-2-hydroxyethyl]propionamide},
2,2'-azobis(2-methyl-N-[1,1-bis(hydroxymethyl)ethyl]propionamide},
2,2'-azobis(2-methyl-N-[2-hydroxyethyl]propionamide},
2,2'-azobis[2-methylpropionamide]dihydrate, etc.

Another monomer which is a chief component of the resin or the resin composition is such that a polymer formed therefrom offers a fixing property and an electroscopic property required for the toner. That is, there will be used one or two or more kinds of monomers having ethylenically unsaturated bonds.

Preferred examples of such a monomer include acrylic monomer, monovinyl aromatic monomer, vinyl ester monomer, vinyl ether monomer, diolefin monomer, monoolefin monomer, etc.

The acrylic monomer will be the one represented by, for example, the following formula (3), $$CH{=}C(R_8){-}COOR_9 \quad (3)$$

wherein $R_8$ is a hydrogen atom or a lower alkyl group, $R_9$ is a hydrogen atom, a hydrocarbon group with up to 12 carbon atoms, or a hydroxyalkyl group,
such as methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, β-hydroxyethyl acrylate, γ-hydroxypropyl acrylate, δ-hydroxybutyl acrylate, β-hydroxyethyl methacrylate, and the like.

The monovinyl aromatic monomer will be a monovinyl aromatic hydrocarbon represented by, for example, the following formula (4), $$CH{=}C(R_{10}){-}\Phi{-}R_{11} \quad (4)$$

wherein $R_{10}$ is a hydrogen atom, a lower alkyl group or a halogen atom, $R_{11}$ is a hydrogen atom, a lower alkyl group, a halogen atom, an alkoxy group, an amino group or a nitro group, and Φ is a phenylene group,
such as styrene, α-methylstyrene, vinyl toluene, α-chlorostyrene, o-, m- or p-chlorostyrene, or p-ethyl styrene, which may be used alone or in a combination of two or more kinds.

There can be further exemplified the monomers of the following general formulas (5), (6), (7) and (8).

A vinyl ester of the following formula (5), $$CH{=}CH{-}OOCR_{12} \quad (5)$$

wherein $R_{12}$ is a hydrogen atom or a lower alkyl group, such as vinyl formate, vinyl acetate, vinyl propionate and the like.

A vinyl ether of the following formula (6), $$CH{=}CH{-}O{-}R_{13} \quad (6)$$

wherein $R_{13}$ is a monovalent hydrocarbon group with up to 12 carbon atoms,
such as vinyl methyl ether, vinyl ethyl ether, vinyl-n-butyl ether, vinyl phenyl ether, vinyl cyclohexyl ether, and the like.

Diolefins of the following formula (7), $$CH{=}C(R_{14}){-}C(R_{15}){=}C{-}R_{16} \quad (7)$$

wherein $R_{14}$, $R_{15}$ and $R_{16}$ are each a hydrogen atom, a lower alkyl group or a halogen atom,
such as butadiene, isoprene, chloroprene, and the like.

Monoolefins of the following formula (8)

$$CH{=}C(R_{17}){-}R_{18} \quad (8)$$

wherein $R_{17}$ and $R_{18}$ are each a hydrogen atom or a lower alkyl group,
such as ethylene, propylene, isobutylene, butene-1, pentene-1, 4-methylpentene-1, and the like.

It is desired that the copolymer resin or the resin composition used in the present invention has cationic polar groups at a concentration of from 1 to 150 millimoles and, particularly, from 5 to 100 millimols per 100 g of the whole resins.

When the concentration of the cationic polar groups in the copolymer resin is smaller than the above-mentioned range, the charging property of the toner becomes unsatisfactory and when the concentration of the cationic polar groups is larger than the above-mentioned range, the toner becomes susceptible to humidity which is not desirable.

A preferred copolymer resin contains, as essential components, a cationic polar group-containing monomer, and one or two or more kinds of acrylic monomers of the formula (1) and, as required, monomers of the formulas (2) to (8) as arbitrary components.

According to the present invention, the cationic polar group-containing copolymer resin can be used alone as described above. Furthermore, a composition containing two or more kinds of cationic polar group-containing copolymer resins or a composition of a cationic polar group-containing copolymer resin and a copolymer resin without having cationic polar group can be used as a resin medium for fixing.

When the resin medium for fixing comprises a resin composition, the concentration of the cationic polar group of the whole resin composition should lie within a range mentioned above with reference to the copolymer resin.

Magnetic Powder

As the magnetic powder pigment, there can be used magnetic powders that have heretofore been used for the conventional magnetic toners, such as tri-iron tetroxide ($Fe_3O_4$), ion sesquioxide ($\gamma$-$Fe_2O_3$), zinc iron oxide ($ZnFe_2O_4$), yttrium ion oxide ($\gamma_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), or the like.

The magnetic powder that is particularly suited for the object of the present invention is a fine granular tri-iron tetroxide (magnetite). A desired magnetite has an orthooctahedral shape with a grain size ranging from 0.05 to 1.0 μm. The magnetite grains may have been treated for their surfaces with a silane coupling agent or a titanium coupling agent.

Toner Composition

The toner composition of the present invention contains the aforementioned resin medium for fixing and the magnetic powder as essential components and may further contain blending agents that have heretofore been blended in the toners. Examples include a coloring agent and a parting agent.

Preferred examples of the coloring agent (pigment) are as described below.

Black Pigment:

Carbon black, acetylene black, lamp black and aniline black.

Yellow Pigment:

Chrome yellow, zinc yellow, cadmium yellow, yellow iron oxide, mineral fast yellow, nickel titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Yellow Lake.

Orange Pigment:

Chrome orange, molybdenum orange, Permanent Orange GTR, pyrazolone orange, Vulcan Orange, Indathlene Brilliant Orange RK, Benzidene Orange G, and Indathlene Brilliant Orange GK.

Red Pigment:

Red iron oxide, cadmium red, red lead, cadmium mercury sulfide, Permanent Red 4R, Lithol Red, pyrazolone red, watching red calcium salt, Lake Red D, Brilliant Carmine 6B, eosin lake, Rhodamine Lake B, Alizarine Lake, and Brilliant Carmine 3B.

Violet Pigment:

Manganese violet, Fast Violet B, and Methyl Violet Lake.

Blue Pigment:

Prussian blue, cobalt blue, Alkali Blue Lake, Victoria Blue Lake, phthalocyanine blue, metal-free phthalocyanine blue, partly chlorinated product of phthalocyanine blue, Fast Sky Blue, and Indathlene Blue BC.

Green Pigment:

Chrome green, chromium oxide, Pigment Green B, Malachite Green Lake, and Final Yellow Green G.

White Pigment:

Zinc flower, titanium oxide, antimony white, and zinc sulfate.

Extender Pigment:

Barite powder, barium carbonate, clay, silica, white carbon, talc, and alumina white.

The above-mentioned pigments are used in amounts of from 2 to 20 parts by weight and, particularly, from 5 to 15 parts by weight per 100 parts by weight of the resin medium for fixing.

As the parting agent for thermal fixing, there can be used a variety of waxes and low molecular olefin resins. As mentioned earlier, however, it is desired in the present invention to use a polypropylene having a number average molecular weight of not smaller than 7000 and, particularly, from 7000 to 30,000. The polypropylene having a molecular weight within the above-mentioned range is available in the trade name of, for example "330P" (number average molecular weight, 15,000, produced by Sanyo Kasei Co.).

Preparation of Toner

The toner of the present invention can be prepared by any widely known method such as a pulverization/classification method, a melt granulating method, a spray granulating method or a polymerization method. Among them, the pulverization/classification method is generally used.

These toner components are pre-mixed using a mixing machine such as Henschel's mixer, kneaded together using a kneading machine such as a biaxial extruder, and the kneaded composition is cooled, pulverized and is classified to obtain the toner.

The toner should have a grain size, i.e., a median diameter of from 5 to 15 μm and, particularly from 7 to 12 μm as measured by using a Coulter counter.

As required, a fluidity-improving agent such as a hydrophobic gas-phase silica or the like can be adhered to the surfaces of the toner grains to improve the fluidity of the toner. The fluidity-improving agent should be added in an amount of 0.1 to 2.0% by weight with respect to the toner.

According to a preferred embodiment of the present invention, the fluidity improving agent further contains spacer grains of grain sizes of from 0.05 to 1.0 μm which are larger than the grain sizes of the fluidity-improving agent to improve the transfer efficiency.

Any organic or inorganic inert regular grains can be used as the spacer gains provided their grain sizes lie within the above-mentioned range. In general, however, it is desired to use the above-mentioned magnetic powder and, particularly, the fine granular tri-iron tetroxide(magnetite). This is because, the magnetic powder that exists being adhered to the surfaces of the toner grains effectively works against the scattering of the toner.

It is desired that the spacer grains such as fine granular tri-ion tetroxide (magnetite) or the like are externally added in an amount of from 0.1 to 10% by weight with respect to the toner.

In externally adding the fluidity-improving agent and the spacer grains to the toner, it is desired that the fluidity-improving agent and the spacer grains are intimately mixed together under the pulverizing conditions, and this mixture is added to the toner followed by pulverization to a sufficient degree.

Applications

According to the present invention, the toner is mixed into the magnetic carrier so as to be used as a two-component-type developing agent.

The magnetic carrier should preferably be the one of the type of ferrite and, particularly, a soft ferrite containing at least one or, preferably, two or more of metal components selected from the group consisting of Cu, Zn, Mg, Mn and Ni, such as sintered ferrite grains and, particularly, spherical grains of a copper-zinc-magnesium ferrite. The surfaces of the magnetic carrier may not be coated but are usually coated with a silicone resin, a fluorine-containing resin, an epoxy resin, an amino resin or an urethane resin.

It is desired that the saturation magnetization of the carrier is from 30 to 70 emu/g and, particularly, from 40 to 60 emu/g. It is desired that the magnetic carrier has a grain size of from 20 to 140 μm and, particularly, from 50 to 100 μm.

The magnetic carrier and-the toner should be mixed together at a ratio of generally from 98:2 to 90:1 on the weight basis and, particularly, at a ratio of from 97:3 to 94:6 on the weight basis.

In carrying out the electrostatic photocopying by using the toner of the present invention, the electrostatic latent image can be formed by any method that has been known per se. For instance, after the photoconducting layer on the conductor substrate is uniformly charged, the electrostatic latent image is formed by exposing the image to light.

The electrostatic latent image can be easily developed by bringing the magnetic brush of the two-component-type developing agent into contact with the substrate. The toner image formed by developing is transferred onto a copying paper, and the toner image is brought into contact with a heated roll to fix it.

EXAMPLES

The invention will now be explained by way of Examples.

Example 1

| (Toner composition) | (Parts by weight) |
|---|---|
| Resin for fixing (styrene-acrylic copolymer having amino group) | 100 |
| Coloring agent (carbon black) | 7 |
| Magnetic powder (magnetite) | 2 |

The above composition was melt-kneaded using a biaxial extruder, and the kneaded material was pulverized using a jet mill, and was classified using a pneumatic classifier to obtain toner grains having an average grain size of 10.0 μm.

To the toner grains were added hydrophobic fine grains having an average grain size of 0,015 μm in an amount of 0.3 parts by weight per 100 parts by weight of the toner grains, and the mixture was mixed together by using Henschel's mixer for two minutes to obtain a toner of the present invention.

Example 2

A toner of the present invention was obtained in the same manner as in Example 1 with the exception of externally adding acrylic resin grains having an average grain size of 0.15 μm as spacer grains.

Example 3

A toner of the present invention was obtained in the same manner as in Example 1 with the exception of externally adding magnetite grains having an average grain size of 0.4 μm as spacer grains.

Comparative Example 1

A toner was obtained in the same manner as in Example 1 with the exception of using, as a resin for fixing, a styrene-acrylic copolymer without having amino group in the resin.

Comparative Example 2

A toner was obtained in the same manner as in Example 1 but without internally adding magnetite.

Comparative Example 3

A toner was obtained in the same manner as in Example 1 but internally adding the magnetite to the toner in an amount of 10 parts by weight.

Comparative Example 4

A toner was obtained in the same manner as in Example 1 but adding a Nigrosine dyestuff (trade name: "N-01" produced by Orient Kagaku Co.) as a charge control agent.

Evaluation of Toner (1) Measurement of Absorbancy

100 Milligrams of the toner was accurately weighed, introduced into a sampling bottle, 50 ml of methanol was added thereto, and the mixture was stirred using a ball mill for 10 minutes and was then left to stand for 15 hours. 20 Milliliters of the supernatant solution was subjected to the centrifuge and was used as a sample for measuring the absorbancy.

The absorbancy was measured by using a spectrophotometer "U-3210" manufactured by Hitachi, Ltd. Results of evaluation are shown in Table 1.

TABLE 1

| | Example | | | Comparative Example | | | |
|---|---|---|---|---|---|---|---|
| (Toner recipe and absorbancy) | 1 | 2 | 3 | 1 | 2 | 3 | 4 |
| Toner composition (parts by wt.) | | | | | | | |
| Fixing resin with amino acid | 100 | 100 | 100 | — | 100 | 100 | 100 |
| Fixing resin without amino acid | — | — | — | 100 | — | — | — |
| Coloring agent (carbon black) | 7 | 7 | 7 | 7 | 7 | 7 | 7 |
| Magnetic powder (magnetite) | 2 | 2 | 2 | 2 | — | 10 | 2 |
| Charge control nigrosine dyestuff | — | — | — | — | — | — | 2 |
| Externally added agent | | | | | | | |
| Silica | 0.3 | 0.3 | 0.3 | 0.3 | 0.3 | 0.3 | 0.3 |
| Acrylic resin grains | — | 0.5 | — | — | — | — | — |
| Magnetite | — | — | 0.5 | — | — | — | — |

TABLE 1-continued

| (Toner recipe and absorbancy) | Example 1 | Example 2 | Example 3 | Comparative Example 1 | Comparative Example 2 | Comparative Example 3 | Comparative Example 4 |
|---|---|---|---|---|---|---|---|
| 400–700 nm | | | | | | | |
| Absorption peak (nm) | 0 | 0 | 0 | 0 | 0 | 0 | 0.65 (579 nm) |
| Absorbancy | | | | | | | |
| 280–350 nm | | | | | | | |
| Absorption peak (nm) | none | none | none | none | none | none | none |
| Absorbancy | | | | | | | |

(2) Test for Evaluation

The toners obtained in the aforementioned Examples and Comparative Examples were blended with a ferrite carrier having an average grain size of 100 μm and were homogeneously mixed to prepare two-component-type developing agents having a toner concentration of 3.5% Then, 100,000 copies were obtained by using an apparatus modified from an electrocopying machine (trade name "DC-7085") produced by Mira Kogyo Co.

A document for copying bore characters, the area of black portions thereof being 8%. The document for measuring the transfer efficiency, on the other hand, possessed the area of black portions inclusive of black solid portions of 15%.

The testing methods were as follows:

(a) Image Density (I.D.)

The density of a black solid portion in the copied image was measured after every predetermined number of copies by using a reflection densitometer (model "TC-6D", manufactured by Tokyo Denshoku Co.).

(b) Fogging Density (F.D.)

The density of the non-image portion was measured by using a reflection densitometer (model "TC-6D", manufactured by Tokyo Denshoku Co.) and was expressed as a difference from a base paper (density of the paper of before being copied). The results of evaluation are shown in Table 2.

(c) Resolution

Copies were obtained by using a document bearing a predetermined chart, and the number of lines was counted on a copied image using a microdensitometer in regard to those having a peak value of not smaller than 0.8, a ground value of not smaller than 0.4, and a difference between the peak value and the ground value of not smaller than 0.6. The results of evaluation were as shown in Table 2.

(d) Transfer Efficiency

The amount of toner in the toner hopper of prior to starting the copying and the amount of toner in the toner hopper after a predetermined number of pieces were copied were measured, and the consumption of toner was calculated from the difference. At the same time, the amount of toner recovered in the step of cleaning while the predetermined number of copies were obtained, was measured to find the amount of toner recovered. From these values, the toner transfer efficiency was calculated in compliance with the following formula after every 20,000 copies. The results of evaluation were as shown in Table 2.

Transfer efficiency (%)=(Amount of toner consumed−(Amount of toner recovered)/(Amount of toner consumed)×100

(e) Scattering of toner

The scattered state of toner in the copying machine after 100,000 copies were obtained was observed by the naked eye, and was evaluated on the following basis. The results of evaluation were as shown in Table 2.

O: Toner did not scatter.

X: Toner scattered.

TABLE 2

(Results of evaluation)

| | Example 1 | Example 2 | Example 3 | Comparative Example 1 | Comparative Example 2 | Comparative Example 3 | Comparative Example 4 |
|---|---|---|---|---|---|---|---|
| I.D. when started | 1.346 | 1.356 | 1.374 | 1.309 | 1.321 | 1.004 | 1.311 |
| 20,000 pieces | 1.323 | 1.353 | 1.356 | 1.221 | 1.156 | 0.956 | 1.342 |
| 40,000 pieces | 1.323 | 1.354 | 1.375 | 1.130 | 1.020 | 0.958 | 1.370 |
| 60,000 pieces | 1.325 | 1.365 | 1.346 | 1.021 | 1.000 | 0.940 | 1.415 |
| 80,000 pieces | 1.334 | 1.345 | 1.368 | 0.956 | 0.934 | 0.936 | 1.408 |
| 100,000 pieces | 1.335 | 1.348 | 1.365 | 0.905 | 0.926 | 0.945 | 0.420 |
| F.D. when started | 0.002 | 0.001 | 0.002 | 0.002 | 0.004 | 0.003 | 0.002 |
| 20,000 pieces | 0.002 | 0.000 | 0.001 | 0.002 | 0.004 | 0.004 | 0.006 |
| 40,000 pieces | 0.003 | 0.000 | 0.002 | 0.002 | 0.003 | 0.004 | 0.010 |
| 60,000 pieces | 0.002 | 0.002 | 0.001 | 0.000 | 0.005 | 0.003 | 0.011 |
| 80,000 pieces | 0.002 | 0.002 | 0.002 | 0.002 | 0.005 | 0.004 | 0.013 |
| 100,000 pieces | 0.003 | 0.001 | 0.001 | 0.001 | 0.005 | 0.005 | 0.015 |
| Resolution (number of lines/mm) | | | | | | | |
| when started | 5.0 | 5.0 | 5.0 | 5.0 | 5.0 | 3.6 | 5.0 |
| 20,000 pieces | 5.0 | 5.6 | 5.0 | 5.6 | 5.0 | 3.6 | 4.5 |
| 40,000 pieces | 5.0 | 5.6 | 5.6 | 5.6 | 5.0 | 3.2 | 4.5 |

TABLE 2-continued

| | (Results of evaluation) | | | | | | |
|---|---|---|---|---|---|---|---|
| | Example | | | Comparative Example | | | |
| | 1 | 2 | 3 | 1 | 2 | 3 | 4 |
| 60,000 pieces | 5.0 | 5.6 | 5.0 | 5.6 | 5.0 | 3.6 | 4.0 |
| 80,000 pieces | 5.0 | 5.0 | 5.6 | 5.6 | 5.0 | 3.6 | 3.6 |
| 100,000 pieces | 5.6 | 5.0 | 5.0 | 5.0 | 5.0 | 3.6 | 3.6 |
| Transfer efficiency (%) | | | | | | | |
| start to 20,000 pieces | 81.4 | 85.9 | 86.5 | 75.2 | 67.1 | 82.1 | 84.9 |
| 20,000 to 40,000 pieces | 80.5 | 84.6 | 86.1 | 71.9 | 62.4 | 81.2 | 81.2 |
| 40,000 to 60,000 pieces | 80.9 | 84.9 | 86.4 | 67.2 | 54.9 | 81.3 | 72.6 |
| 60,000 to 80,000 pieces | 81.0 | 84.8 | 86.5 | 64.9 | 51.4 | 80.5 | 63.9 |
| 80,000 to 100,000 pieces | 81.1 | 85.0 | 86.5 | 60.5 | 48.9 | 79.9 | 50.9 |
| Scattering of toner | ○ | ○ | ○ | ○ | X | ○ | X |

(f) Amount of spent

The developing agent was sampled after a predetermined number of copies and each sample was placed on a sieve of 400 mesh, and was attracted from the lower direction by using a blower to separate it into the toner and the carrier. 5 Grams of the carrier left on the sieve was introduced into a beaker followed by the addition of toluene, so that the toner adhered on the surfaces of the carrier was dissolved. Then, the toluene solution was discarded away in a state where the carrier was attracted by a magnet from the lower side of the beaker. This operation was repeated several times until the toluene became colorless. The toluene was then driven off in an oven to measure the weight. A difference between the weight contained in the beaker and the weight after drying is the amount of spent. The amount of spent was expressed in terms of milligrams of the spent toner adhered per a gram of the carrier. The results of evaluation were as shown in Table 3.

(g) Amount of electric charge of the toner

200 Milligrams of the developing agent was measured by an ordinary method using a "Blow-Off Powder Charge Measuring Device" produced by Toshiba Chemical Co., and was expressed in terms of the amount of electric charge per a gram of the toner. The results of evaluation were as shown in Table 3.

(h) Electric resistance of the developing agent

200 Milligrams of the developing agent was introduced into a measuring jig with an electrode gap of 2 mm, and a bridge of the developing agent was formed across the electrodes by bringing magnets of 1500 gausses from both sides thereof. A voltage of 1000 V was applied across the electrodes, and the electric resistance was calculated from the electric current that flowed between the electrodes. The results of evaluation were as shown in Table 3.

TABLE 3

| | (Results of evaluation) | | | | | | |
|---|---|---|---|---|---|---|---|
| | Example | | | Comparative Example | | | |
| | 1 | 2 | 3 | 1 | 2 | 3 | 4 |
| Amount of spent (mg) | | | | | | | |
| when started | 0 | 0 | 0 | 0 | 0 | 0 | 0 |
| 20,000 pieces | 0.06 | 0.05 | 0.05 | 0.06 | 0.04 | 0.04 | 0.35 |
| 40,000 pieces | 0.13 | 0.10 | 0.09 | 0.12 | 0.12 | 0.08 | 0.60 |
| 60,000 pieces | 0.17 | 0.13 | 0.15 | 0.18 | 0.17 | 0.12 | 0.95 |
| 80,000 pieces | 0.22 | 0.19 | 0.19 | 0.24 | 0.22 | 0.19 | 1.32 |
| 100,000 pieces | 0.29 | 0.23 | 0.22 | 0.30 | 0.28 | 0.23 | 1.56 |
| Amount of electric charge (μC/g) | | | | | | | |
| when started | 19.0 | 17.2 | 15.9 | 19.9 | 18.4 | 16.9 | 24.0 |
| 20,000 pieces | 21.3 | 19.4 | 17.3 | 25.3 | 23.9 | 18.1 | 27.0 |
| 40,000 pieces | 22.3 | 20.1 | 18.1 | 26.5 | 30.6 | 17.2 | 23.3 |
| 60,000 pieces | 23.0 | 19.5 | 18.4 | 29.4 | 34.3 | 19.5 | 14.3 |
| 80,000 pieces | 23.6 | 19.9 | 18.3 | 33.6 | 38.6 | 19.3 | 11.0 |
| 100,000 pieces | 23.2 | 19.7 | 17.9 | 35.5 | 40.2 | 19.8 | 8.2 |
| Electric resistance of (Ω) the developing agent | $7 \times 10^9$ | $7 \times 10^9$ | $8 \times 10^9$ | $8 \times 10^9$ | $2 \times 10^9$ | $8 \times 10^{12}$ | $7 \times 10^9$ |

(3) Consideration of the Results of Evaluation Examples 1 to 3 exhibited very stable image density, fogging, resolution and transfer efficiency and favorably suppressed toner scattering.

According to Comparative Example 1 using a resin without cationic group, on the other hand, the amount of electric charge greatly increased with an increase in the number of copies, resulting in a decrease in the image density and in the transfer efficiency.

Even in Comparative Example 2 without containing magnetic powder, the amount of electric charge greatly increased, and the image density and the transfer efficiency were deteriorated. In addition, the scattering of toner increased progressively with an increase in the number of copies.

In the case of Comparative Example 3 using the magnetic powder in-large amounts, the amount of electric charge did not increase but the image density was on a low level from the start. The resolution greatly decreased, too. This was due to that the earing state of the developing agent was too strong or the electric resistance of the developing agent was very high.

In the cases of Comparative Example 4 using a charge control agent, the amount of charge of the toner decreased with an increase in the number of copies, the fogging increased, and the transfer efficiency decreased. The decrease in the amount of charge of the toner is attributed to that the toner was spent in large amounts.

Application Example 1

| (Toner Composition) | (parts by weight) |
|---|---|
| Resin for fixing (styrene-acrylic resin having amino group) | 100 |
| Coloring agent (carbon black) | 7 |
| Parting agent (polypropylene having a number average molecular weight of 8000) | 3 |
| Magnetic powder (magnetite) | 2 |

The above composition was melt-kneaded by using a biaxial extruder, and the kneaded material was pulverized using a jet mill and was classified using a pneumatic classifier to obtain grains of a size of 10 μm.

To the above grains were added 0.3 parts by weight of hydrophobic fine silica grains having an average grain size of 0.015 μm and 0.5 parts by weight of magnetite grains having a grain size of 0.3 μm as spacer grains, and were mixed together using a Henschel's mixer to obtain a toner.

Application Example 2

A toner was obtained in the same manner as in Application Example 1 with the exception of using a polypropylene having a number average molecular weight of 15000 as a parting agent.

Application Example 3

A toner was obtained in the same manner as in Application Example 1 with the exception of using a polypropylene having a number average molecular weight of 4000 as a parting agent.

Application Example 4

A toner was obtained in tile same manner as in Application Example 1 with the exception of using a polypropylene having a number average molecular weight of 6000 as a parting agent.

Method of Evaluation

45 Grams of each of the toners of Application Examples 1 to 4 and 955 g of a ferrite carrier of 80 μm were mixed together to obtain starting agents. By using these starting agents and a copying machine modified from a copying machine, Model DC-4685, manufactured by Mira Kogyo Co., 100,000 pieces of copies were obtained. The copying conditions and the methods of evaluating performance were the same as those of evaluating the aforementioned Examples. Table 4 shows the results of evaluation.

TABLE 4

| | Application Example | | | |
|---|---|---|---|---|
| | 1 | 2 | 3 | 4 |
| Image density | | | | |
| when started | 1.411 | 1.396 | 1.395 | 1.388 |
| 100,000 pieces | 1.405 | 1.375 | 1.411 | 1.415 |
| Fogging | | | | |
| when started | 0.003 | 0.002 | 0.001 | 0.001 |
| 100,000 pieces | 0.003 | 0.003 | 0.009 | 0.010 |
| Transfer efficiency | | | | |
| when started | 83.2 | 84.9 | 81.2 | 82.2 |
| 100,000 pieces | 82.2 | 83.0 | 60.9 | 65.1 |
| Amount of spent (mg) after 100,000 copies | 0.53 | 0.47 | 2.23 | 1.53 |

We claim:

1. A positively-charging toner for a two-component magnetic developing agent having excellent spent resistance, said toner comprising a resin medium for fixing selected from the group consisting of a copolymer resin having cationic polar groups and a resin composition having cationic polar groups; and a magnetic: powder in an amount of from 0.1 to 5 parts by weight per 100 parts by weight of said resin medium; wherein a methanol extract of said toner exhibits absorbancies which are substantially zero at absorption peaks over wavelengths of from 400 to 700 nm.

2. A toner according to claim 1, wherein said toner comprises grains having grain sizes of from 5 to 15 μm on the basis of volume and further comprises a fine powdery fluidity-improving agent adhered onto the toner grains, said fine powdery fluidity-improving agent containing spacer grains having grain sizes of from 0.05 to 1.0 μm on the basis of volume.

3. A toner according to claim 1, wherein said cationic polar group is contained in an amount of from 1 to 150 millimols per 100 g of the copolymer resin or the resin composition.

4. A toner according to claim 3, wherein said cationic polar group is a basic nitrogen-containing group.

5. A toner according to claim 4, wherein said basic nitrogen-containing group is an amino group or a quaternary ammonium group.

6. A toner according to claim 1, wherein said resin medium for fixing is a copolymer of a basic nitrogen-containing (meth)acrylic monomer represented by the following formula,

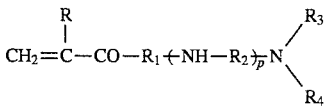

wherein

R is a hydrogen atom or a methyl group, $R_1$ and $R_2$ are each an alkylene group, $R_3$ and $R_4$ are each a hydrogen atom or an alkyl group, and p is 0 or 1, or a quaternary ammonium salt thereof; or a resin composition which contains a polymer of said monomer.

7. A toner according to claim 1, wherein in said resin medium for fixing is dispersed a polypropylene having a number average molecular weight of not smaller than 7000 in an amount of from 0.1 to 6 parts by weight per 100 parts by weight of said medium.

* * * * *